US010457447B2

(12) United States Patent
Allen

(10) Patent No.: US 10,457,447 B2
(45) Date of Patent: Oct. 29, 2019

(54) PACKAGED CONSUMER PRODUCT

(71) Applicant: The Procter & Gamble Company, Cincinnati, OH (US)

(72) Inventor: Matthew Richard Allen, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/529,581

(22) Filed: Oct. 31, 2014

(65) Prior Publication Data

US 2015/0144517 A1 May 28, 2015

Related U.S. Application Data

(60) Provisional application No. 61/907,423, filed on Nov. 22, 2013.

(51) Int. Cl.

| | |
|---|---|
| ***B65D 85/00*** | (2006.01) |
| ***B65D 25/20*** | (2006.01) |
| ***B65D 51/24*** | (2006.01) |
| ***B65D 51/00*** | (2006.01) |

(52) U.S. Cl.

CPC ..... *B65D 25/205* (2013.01); *B65D 51/00* (2013.01); *B65D 51/245* (2013.01); *B65D 2203/02* (2013.01)

(58) Field of Classification Search

CPC .... B65D 51/00; B65D 51/245; B65D 25/205; B65D 2203/02

USPC ..... 206/459.5; 40/310, 312

See application file for complete search history.

(56) References Cited

U.S. PATENT DOCUMENTS

| | | | | |
|---|---|---|---|---|
| D403,123 | S * | 12/1998 | Sgariboldi | D28/76 |
| 5,941,394 | A * | 8/1999 | Siegler | A61J 7/04 206/366 |
| 6,637,964 | B1 * | 10/2003 | Kuo | 401/55 |
| 7,614,498 | B2 * | 11/2009 | O'Keefe | 206/459.5 |
| 2004/0217022 | A1 | 11/2004 | Irvine et al. | |
| 2005/0167307 | A1 * | 8/2005 | Cheng | 206/385 |
| 2006/0163110 | A1 * | 7/2006 | Adler | B65D 1/0223 206/534 |
| 2007/0256951 | A1 | 11/2007 | O'Keefe | |
| 2008/0116213 | A1 | 5/2008 | Schlaupitz et al. | |
| 2009/0120825 | A1 * | 5/2009 | Ruman et al. | 206/459.5 |
| 2009/0197231 | A1 * | 8/2009 | Sosalla | 206/459.5 |
| 2009/0212954 | A1 | 8/2009 | Adstedt et al. | |

FOREIGN PATENT DOCUMENTS

| | | |
|---|---|---|
| DE | 2425774 A1 | 12/1975 |
| JP | 2005200101 | 7/2005 |
| JP | 2006248600 | 9/2006 |

OTHER PUBLICATIONS

International Search Report dated Jan. 20, 2015, 5 pgs.

* cited by examiner

*Primary Examiner* — Luan K Bui

(74) *Attorney, Agent, or Firm* — Sarah M DeCristofaro

(57) ABSTRACT

A packaged consumer product comprising: a package container; a consumer product disposed within the package container; a package closure disposed in communication with the package container; and an indicia comprising an array of visual elements disposed upon adjacent surfaces of the package container and package closure.

14 Claims, 2 Drawing Sheets

PACKAGED CONSUMER PRODUCT

FIELD OF THE INVENTION

The invention relates to packaged products. The invention relates particularly to decorated packaged consumer products.

BACKGROUND OF THE INVENTION

Packaged consumer products are well known. The packaging of these products serves a number of functions. The products integrity is preserved until the consumer of the product seeks to use the product. The product is made available to shoppers in a manner that facilitates the purchase and transport of the product from a sales outlet to a point of use of the product. Packaging of products also serves as a marketing means. The package of a product may be used as an identifier of the product or brand, as an indicator of the source of the product. The particular information displayed upon, or near, the packaging at the point of sale may serve to convey product relevant information to potential purchasers of the product. Information and/or indicia arrayed upon packaging associated with particular products may additionally serve as a marketing means through the depiction of the decorated package in print, on-line of video broadcast advertising related to the product.

One challenge facing manufacturers, distributors, retailers, and marketers is capturing the attention of shoppers in an increasingly stimulating environment and in differentiating their particular product offerings in a positive manner from competing product offerings.

What is needed is a mechanism to enable selected products to stand out on the shelf at a retailer, or to capture the imagination of a target market demographic when displayed in marketing materials.

SUMMARY OF THE INVENTION

In one aspect, the invention comprises a packaged consumer product comprising: a package container; a consumer product disposed within the package container; a package closure disposed in communication with the package container; and an indicia comprising an array of visual elements disposed upon adjacent surfaces of the package container and package closure.

DETAILED DESCRIPTION OF THE INVENTION

Figure 1:
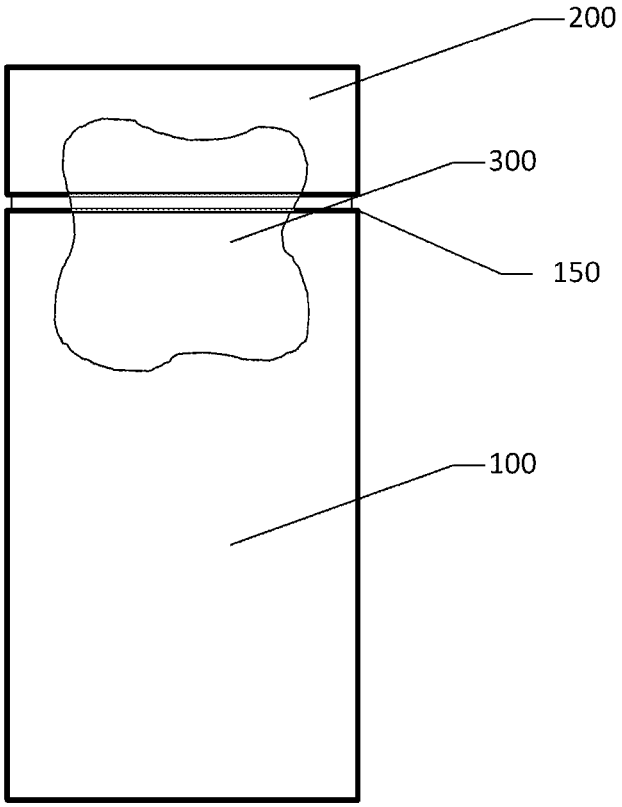
FIG. 1 provides a schematic illustration of one embodiment of the invention.

The following description of the invention includes descriptive listing of aspects of the invention. The listing may be set forth as exemplifying the particular aspect or as being exemplary forms of that aspect. Nothing in such listings should be construed as setting forth a limiting description of the respective aspects.

The terms "product(s)" and "consumer product" are used in the broadest sense and refers to any product, product group, services, communications, entertainment, environments, organizations, systems, tools, and the like. For example, an example of a product group is personal and household products, such as used by a person, family or household. Examples of a representative, and non-limiting list of product categories within the personal and household product group includes antiperspirants, baby care, colognes, commercial products (including wholesale, industrial, and commercial market analogs to consumer-oriented consumer products), cosmetics, deodorants, dish care, feminine protection, hair care, hair color, health care, household cleaners, laundry, oral care, paper products, personal cleansing, disposable absorbent articles, pet health and nutrition, prescription drugs, prestige fragrances, skin care, foods, snacks and beverages, special fabric care, shaving and other hair growth management products, small appliances, devices and batteries, services such as haircutting, beauty treatment, spa treatment, medical, dental, vision services, entertainment venues such as theaters, stadiums, as well as entertainment services such as film or movie shows, plays and sporting events A variety of product forms may fall within each of these product categories.

Exemplary product forms and brands are described on The Procter & Gamble Company's website www.pg.com, and the linked sites found thereon. It is to be understood that consumer products that are part of product categories other than those listed above are also contemplated by the present invention, and that alternative product forms and brands other than those disclosed on the above-identified website are also encompassed by the present invention.

Exemplary products within the laundry category include detergents (including powder, liquid, tablet, and other forms), bleach, conditioners, softeners, anti-static products, and refreshers (including liquid refreshers and dryer sheets). Exemplary products within the oral care category include dentifrice, floss, toothbrushes (including manual and powered forms), mouth rinses, gum care products, tooth whitening products, and other tooth care products. Exemplary feminine protection products include pads, tampons, interlabial products, and pantiliners. Exemplary baby care products include diapers, wipes, baby bibs, baby change and bed mats, and foaming bathroom hand soap.

Exemplary health care products include laxatives, fiber supplements, oral and topical analgesics, gastro-intestinal treatment products, respiratory and cough/cold products, heat delivery products, and water purification products. Exemplary paper products include toilet tissues, paper towels, and facial tissues. Exemplary hair care products include shampoos, conditioners (including rinse-off and leave-in forms), and styling aids. Exemplary household care products include sweeper products, floor cleaning products, wood floor cleaners, antibacterial floor cleaners, fabric and air refreshers, and vehicle washing products. Skin care products include, but are not limited to, body washes, facial cleansers, hand lotions, moisturizers, conditioners, astringents, exfoliation products, micro-dermabrasion and peel products, skin rejuvenation products, anti-aging products, masks, UV protection products, and skin care puffs, wipes, discs, clothes, sheets, implements and devices (with or without skin care compositions).

Other product groups include but are not limited to: sports equipment, entertainment (books, movies, music, etc), vision, and in-home-consumed medical and first aid, among others.

The terms "package container" and "container" are used interchangeably herein to denote the main body of a composite package system having more than a single element. The container may be comprised of any of a variety of packaging materials as well as combinations of packaging materials. Exemplary packaging materials include polymeric materials including hdpe, pet, lldpe, abs, and pp, glass, wood, ceramic, metal and various grades of paper, composite materials, as well as combinations of the above.

The package container may be manufactured using known methods for the fabrication of containers. Exemplary methods include blow molding, machining, injection molding, drawing, adhesive assembly and combinations of these.

The terms "package closure" and "closure" are used interchangeably herein to denote that portion of a package system operably connected to the container portion and functioning to control access to the product within the container by a consumer of the product. The closure also may serve to prevent unintentional dispensing of the product from the container.

The closure may be fabricated utilizing similar materials as those set forth with regard to the container. Similar methods of manufacture may also be used in the creation of the closure elements. The respective closure and container elements of any particular package system may be comprised of similar or dissimilar materials and may be manufactured through the use of similar or differing methods.

The closure may comprise an element intended to attach the closure to the container including a threaded element, a snap fit configuration or other securing mechanisms. The closure may be designed to be popped open and closed, to be twisted open and closed, or screwed and unscrewed from the container to afford a use access to the contents of the package system. The closure may afford access to the product without being removed from the package in an embodiment such as a flip top cap wherein the closure remains affixed to the container but provides an operable access point for opening and closing access to the product.

The container and closure may comprise one or more protective or decorative coatings beyond the system indicia described below. The coatings may be disposed upon the elements for purposes of decoration or for protecting package surfaces or previously applied decoatrive elements.

The package system may comprise the primary packaging for a product and contain the product for dispensing and nothing more. In one embodiment, the package system may comprise secondary or higher level packaging which in turn contains the primary packaging system associated with the product.

The design of the packaging system defines the interface between the container and the closure. The interface may be the result of overlapping surfaces such that little or no gap or break in the external surface of the combined system is discernible. The combination may have a noticeable interface gap wherein the system surface is noticeably disturbed or broken at the juncture between the container and the closure. The extent and nature of the interface may be considered in the design of the indicia intended for application upon the surface of the package system. In one embodiment, the indicia may be designed without regard for the presence or nature of an interface between the respective elements. In one embodiment, the indicia design may consider the presence of an interface and may be configured to include a zone corresponding in location to the interface such that the applied indicia will result in an overlay of this zone upon the interface area. The described zone may comprise little or no deposit of visual material upon the surface. In this manner, the indicia may be designed to accommodate the presence of a gap in the surface of the package system by not disposing visual elements upon and potentially near, the interface gap. The zone may extend for a small distance from one or both edges of the gap of the interface. In one embodiment, the zone may extend about 1-2 millimeters from one or both edges of the gap. In one embodiment, the zone may extend about 2-6 millimeters from the gap. The design of the indicia may be configured such that the gap constitutes an accent or other intended design element within the overall design of the indicia.

As used herein, the term "indicia" refers to an observable image disposed upon an outer surface of a package element. The indicia may comprise alpha-numeric characters, product brand logos or other brand equity elements, visual elements associated with an aspect of the use of the product, geometric shapes, amorphous shapes and combinations of these. The indicia may be comprised of a single color or of a combination of colors disposed in one or more layers upon the surface. The indicia may comprise protective coatings disposed as a layer upon the visual elements of the indicia intended to provide protection from mechanical damage or other degrading influences present in the manufacturing, retail, wholesale or use environments envisioned for the package system.

The indicia may be disposed upon the surface of the package using printing equipment adapted for that purpose. The indicia may be disposed upon a surface as an array of discrete visual elements comprised of one or more colored liquid materials such as ink or paint. The discrete visual elements may be discrete and independent from each other or they may partially or completely overlap with each other and may comprise a network of elements which yield a composite image when viewed by an observer of the array of elements. In one embodiment, a Roland LEF-12, UV flatbed printer, available from the Roland, DGA, Corp. of Irvine, Calif., may be utilized to apply indicia to a package—product—closure combination via the proper disposition of up to six respective colors or other variants of materials. As an example, the printer may be used to apply colors from a palette of Cyan-magenta-yellow-black, together with additional options to apply white and also a clear over-varnish to render the desired indicia upon the package system elements surfaces.

As illustrated in FIG. 1, a package container 100 is combined with a package closure 200 creating interface 150. The indicia 300 is disposed across the interface 150 upon the surfaces of each of the container 100 and the closure 200.

Figure 2:
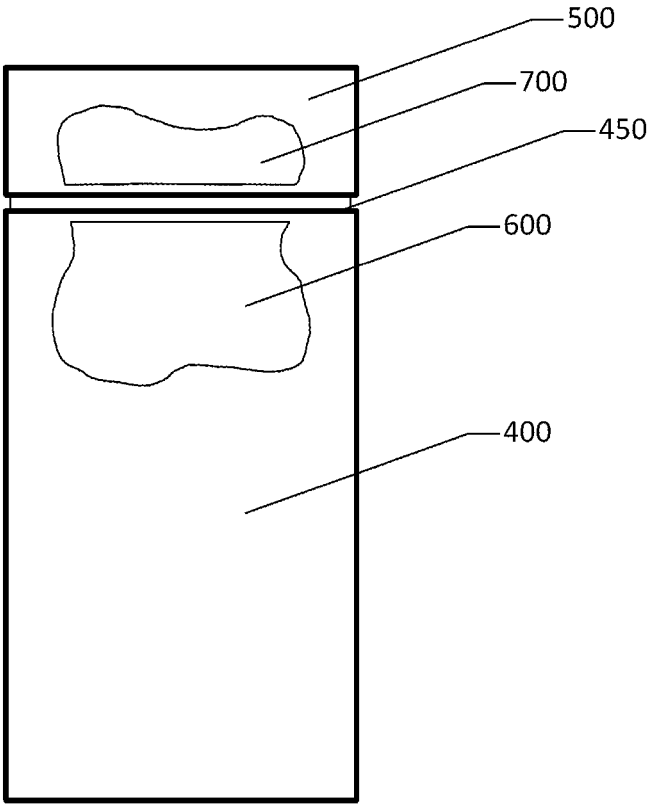
FIG. 2 provides a schematic illustration of a second embodiment of the invention.

As illustrated in FIG. 2, the package container 400 and package closure 500 are combined yielding an interface 450. Portions 600 and 700 combine to form the indicia arrayed upon the surfaces of the closure and the container with a zone across the interface wherein no indicia visual is applied.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaged consumer product comprising:

a package container;

a consumer product disposed within the package container;

a package closure disposed in communication with the package container;

an indicia comprising an array of discrete visual elements disposed in two or more layers upon adjacent surfaces of the package container and package closure, wherein the package container comprises two or more discrete visual elements and the package closure comprises two or more discrete visual elements, wherein the array of discrete visual elements comprise a network of elements that form a composite image; and an interface gap between the package container and the package closure, wherein the indicia comprises an image-free zone corresponding to the location of the interface gap.

2. The packaged consumer product of claim 1, wherein the package container and the package closure are comprised of dissimilar materials.

3. The packaged consumer product of claim 1, wherein the package closure may be opened or removed to afford access to the consumer product.

4. The packaged consumer product of claim 1, wherein the indicia is associated with a brand equity of the consumer product.

5. The packaged consumer product of claim 1, wherein the indicia is associated with the category of the product.

6. A packaged consumer product comprising:

a package container;

a consumer product disposed within the package container;

a package closure disposed in communication with the package container;

an indicia comprising an array of discrete visual elements disposed in two or more distinct layers upon adjacent surfaces of the package container and package closure; and an interface gap between the package container and the package closure wherein the indicia comprises an image-free zone corresponding to the location of the interface gap and wherein the array of discrete visual elements comprise a network of elements to form a composite image.

7. The packaged consumer product of claim 6, wherein the image-free zone extends about 1 millimeter from one or both edges of the interface gap.

8. The packaged consumer product of claim 6, wherein the image-free zone extends about 1 to 2 millimeters from one or both edges of the interface gap.

9. The packaged consumer product of claim 6, wherein one of the two or more distinct layers of the array of discrete visual elements comprise a protective coating.

10. The packaged consumer product of claim 6, wherein each the discrete visual elements comprise one or more liquid materials.

11. A packaged consumer product comprising:

a package container;

a consumer product disposed within the package container;

a package closure disposed in communication with the package container;

an indicia comprising an array of discrete visual elements disposed in two or more layers upon surfaces of the package container and package closure, wherein the package container comprises a first discrete visual element and the package closure comprises a second discrete visual element, and wherein the first discrete visual element and the second discrete visual element are different; and an interface gap between the package container and the package closure, wherein the indicia comprises an image-free zone corresponding to the location of the interface gap, and wherein the discrete visual elements comprise a network of elements to form a composite image.

12. The packaged consumer product of claim 11, wherein the image-free zone extends about 1 millimeter from one or both edges of the interface gap.

13. The packaged consumer product of claim 11, wherein the image-free zone extends about 1 to 2 millimeters from one or both edges of the interface gap.

14. The packaged consumer product of claim 11, wherein the image-free zone extends about 2 to 6 millimeters from one or both edges of the interface gap.

* * * * *